US008448277B2

(12) United States Patent
Fechler et al.

(10) Patent No.: US 8,448,277 B2
(45) Date of Patent: May 28, 2013

(54) METHOD FOR TREATING LAUNDRY IN A WASHING MACHINE, AND WASHING MACHINE

(75) Inventors: Marion Fechler, Guetersloh (DE); Volker Karweg, Guetersloh (DE); Dirk Sieding, Luenen (DE)

(73) Assignee: Miele & Cie. KG, Guetersloh (DE)

( * ) Notice: Subject to any disclaimer, the term of this patent is extended or adjusted under 35 U.S.C. 154(b) by 1125 days.

(21) Appl. No.: 12/367,641

(22) Filed: Feb. 9, 2009

(65) Prior Publication Data

US 2009/0199350 A1 Aug. 13, 2009

(30) Foreign Application Priority Data

Feb. 11, 2008 (DE) ..... 10 2008 008 645

(51) Int. Cl.
*D06F 35/00* (2006.01)
*D06F 25/00* (2006.01)

(52) U.S. Cl.
CPC ..... *D06F 35/00* (2013.01); *D06F 25/00* (2013.01)
USPC ..... 8/159

(58) Field of Classification Search
CPC ..... D06F 35/00; D06F 25/00
USPC ..... 8/158, 159
See application file for complete search history.

(56) References Cited

U.S. PATENT DOCUMENTS

| | | | | |
|---|---|---|---|---|
| 4,207,683 | A * | 6/1980 | Horton | 34/60 |
| 5,782,012 | A * | 7/1998 | Sanders et al. | 34/527 |
| 7,325,330 | B2 * | 2/2008 | Kim et al. | 34/407 |
| 7,406,737 | B2 * | 8/2008 | Yang et al. | 8/158 |
| 7,690,063 | B2 * | 4/2010 | McAllister et al. | 8/159 |
| 7,966,683 | B2 * | 6/2011 | Herkle et al. | 8/149.3 |
| 2005/0034248 | A1 * | 2/2005 | Oh et al. | 8/149.3 |
| 2005/0160536 | A1 * | 7/2005 | McAllister et al. | 8/137 |
| 2006/0117596 | A1 * | 6/2006 | Kim et al. | 34/607 |
| 2007/0130697 | A1 * | 6/2007 | Oh et al. | 8/149.3 |
| 2009/0193593 | A1 * | 8/2009 | Kirigakubo et al. | 8/142 |
| 2010/0000117 | A1 * | 1/2010 | Choi et al. | 34/443 |

FOREIGN PATENT DOCUMENTS

| | | |
|---|---|---|
| EP | 1275767 | 1/2003 |
| EP | 1555338 | 7/2005 |
| EP | 1657345 | 5/2006 |

* cited by examiner

*Primary Examiner* — Joseph L Perrin
(74) *Attorney, Agent, or Firm* — Leydig, Voit & Mayer, Ltd.

(57) ABSTRACT

A method of treating laundry in a washing machine having a substantially rotatable drum disposed in a suds container. The method includes heating the drum wall with a heater during a laundry smoothing cycle and rotating the drum during the smoothing cycle at a first speed so as to lift the laundry in the drum to a height at which the laundry slides down the drum wall.

10 Claims, 5 Drawing Sheets

METHOD FOR TREATING LAUNDRY IN A WASHING MACHINE, AND WASHING MACHINE

CROSS REFERENCE TO RELATED APPLICATIONS

Priority is claimed to German Patent Application No. DE 10 2008 008 645.2, filed Feb. 11, 2008, the entire disclosure of which is hereby incorporated by reference herein.

FIELD

The present invention relates to a method for treating laundry in a washing machine that includes a cycle for smoothing the laundry.

BACKGROUND

When washing laundry in a drum-type washing machine, the laundry is moved in the drum for about 40 to 120 minutes, thereby producing the mechanical washing action. During this process, the suds container; i.e., the drum, contains water which, in conjunction with the movement of the laundry, allows the dirt to be washed out. This movement produces wrinkles in the laundry, the wrinkling being aggravated during the final spinning operation, during which the laundry items are pressed against the wall of the drum by centrifugal force. In order to avoid wrinkling and/or to smooth the laundry, EP 1 657 345 A2 describes injecting steam into the drum while the drum is rotated. Disadvantageously, the dewrinkling effect produced in this manner may be minimal because the laundry is still wet and, therefore, can absorb only small amounts of steam. Moreover, an additional steam generating means is required, which adds to the technical complexity and cost of the washing machine.

EP 1 275 767 A1 describes generating the steam using the heating element that is provided for the wash liquid in the suds container. EP 1 555 338 A2 describes injecting the steam into the drum while the drum is rotated at a speed higher than that at which the laundry is pressed against the wall of the drum. During this process, existing wrinkles may become worse due to the forced contact against the wall of the drum. Since the wet laundry does not absorb or absorbs only small amounts of steam, only a minor dewrinkling effect is achieved.

SUMMARY

An aspect of the present invention is to provide an improved method for dewrinkling laundry in a drum-type washing machine, and a washing machine for carrying out said method.

In an embodiment, the present invention provides a method of treating laundry in a washing machine having a rotatable drum disposed in a suds container. The method includes heating the drum wall with a heater during a laundry smoothing cycle and rotating the drum during the smoothing cycle at a first speed so as to lift the laundry in the drum to a height at which the laundry slides down the drum wall.

BRIEF DESCRIPTION OF THE DRAWINGS

An exemplary embodiment of the present invention will be described in more detail below and is schematically shown in the drawings, in which.

DETAILED DESCRIPTION

Figure 1:
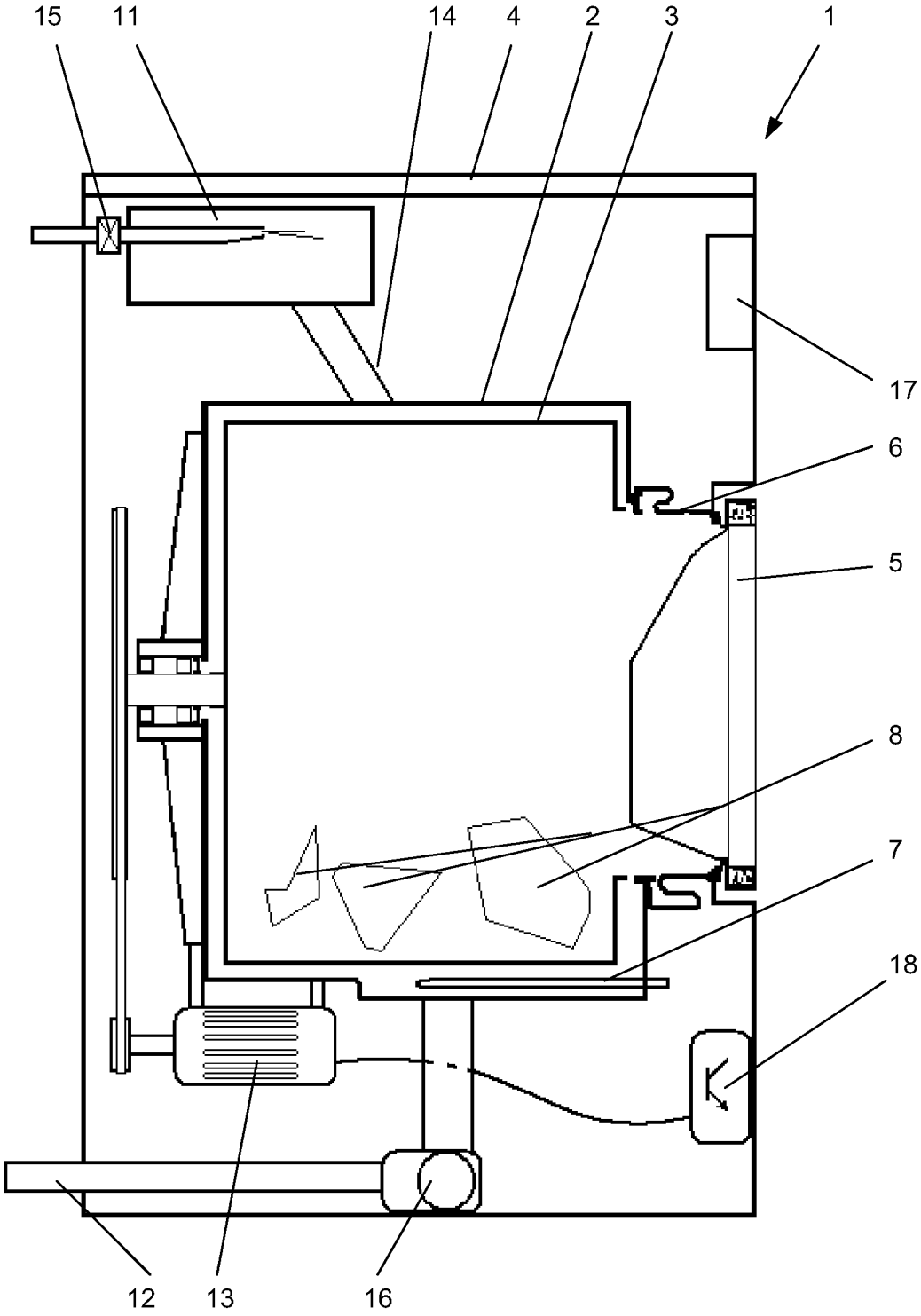
FIG. 1 is a schematic cross-sectional view of a washing machine.

In an embodiment, the present invention provides a washing machine or a washer-dryer machine including a housing, a suds container resiliently mounted therein, a drum drivable by a motor and rotatably mounted in the suds container, and further including a heater disposed in the suds container, and a controller adapted to control the motor and the heater to perform a method of smoothing laundry.

In an embodiment, the method of the present invention allows for easy dewrinkling of laundry items without having to make any constructional changes in the washing machine. According to the method of this embodiment, during the cycle for smoothing the laundry, the drum wall is heated, and the drum is rotated at a relatively low speed, at which the laundry is lifted only to a level where it slides along the wall of the drum. During this cycle, the suds container and/or the drum, contains no or only a small amount of wash liquid, so that no wetting of the laundry items occurs. Therefore, the still wet laundry slides along a hot and/or substantially dry drum wall; i.e., the wall of the drum slides along under the laundry, whereby the laundry is smoothed in a manner similar to ironing. In the process, the moisture present in the laundry evaporates, at least partially, on the hot drum wall, which provides additional drying of the laundry. The steam so produced in turn improves the loosening of the laundry, so that already existing wrinkles are reduced.

For this purpose, it is suitable to rotate the drum at a speed in the range of 15 to 25 rpm. Thus, in a drum of a conventional household washing machine, the desired sliding effect is reliably achieved, while preventing laundry from being carried along with the drum until it detaches from the drum wall. When the speeds are in the above-mentioned range, the laundry is carried along no further than from the 6 o'clock position to the 9 o'clock or 3 o'clock position, from where it slides along the wall of the drum to the 6 o'clock position.

In an embodiment, the partial revolution is about one-quarter to one-half of a full revolution. This ensures that the laundry will not be carried along to a point where it would fall down.

In this connection, the drum wall can be heated to a temperature of about 50 to 70° C. In this manner, an ironing effect is achieved, such as when ironing using a iron and a damp cloth, or using a steam iron.

To ensure that preferably all laundry items will slide along the drum wall, the cycle includes several phases. In a sliding phase, the drum is rotated at the low speed for about 2 to 6 partial revolutions, whereas during a subsequent repositioning phase, it is rotated at a higher speed which causes the laundry to be repositioned within the drum.

In a suitable embodiment, the higher speed is in the range of 40 to 60 rpm to ensure reliable repositioning of the laundry within the drum.

In an embodiment, the sliding phases last about 30 to 60 seconds, and the repositioning phases last about 5 to 10 seconds, the cycle for smoothing the laundry including more than two sliding phases and respective subsequent repositioning phases.

In an embodiment, the cycle can include 6 to 10 sliding phases and respective subsequent repositioning phases. This ensures that all laundry items will contact the hot drum wall several times. The last repositioning phase is followed by a cooling phase, during which the heater is off and the drum is rotated in a reversing fashion at the higher speed for about 60 to 120 seconds. In this way, the laundry is loosened as it is cooled, thus allowing wrinkles in the laundry to be further reduced or removed.

The present invention also relates to a washing machine including a housing, a suds container resiliently mounted therein, a drum drivable by a motor and rotatably mounted in the suds container, and further including a water inlet valve, a drain, and a controller by which the motor, the water inlet valve, and the drain can be controlled to carry out the above method or embodiments mentioned herein.

FIG. 1 schematically illustrates a washing machine 1 having a suds container 2. Positions and directions are given relative to washing machine 1 in its upright position of use. A drum 3 driven by an electric motor 13 is rotatably mounted within suds container 2, said drum moving laundry items 8 present in suds container 2. In the described embodiment, drum 3 is made of stainless steel and is provided with a plurality of openings permitting flow therethrough. Housing 4 has a loading opening 9 which allows access to the interior of drum 3 through bellows seal 6. Loading opening 9 can be closed by a door 5. A heating element 7 capable of heating the wash liquid in suds container 2 is disposed in the lower region of the suds container. An inlet valve 15 is indicated in the upper portion of appliance 1, said inlet valve controlling the introduction of water from the water supply system. Water is introduced into suds container 2 through dispensing compartment 11 and connecting tube 14. In the process, detergent which has been filled into dispensing compartment 11 is washed into suds container 2. Disposed below suds container 2 is a drain 12 through which the used wash liquid or the rinse liquid is passed from suds container 2 to drain conduit 16, which generally discharges into a sewer. Controller 17 controls water inlet 15, the activity of drain 12, heating element 7, and drive motor 13, which is energized by the power section or a frequency converter 18.

Figure 2:
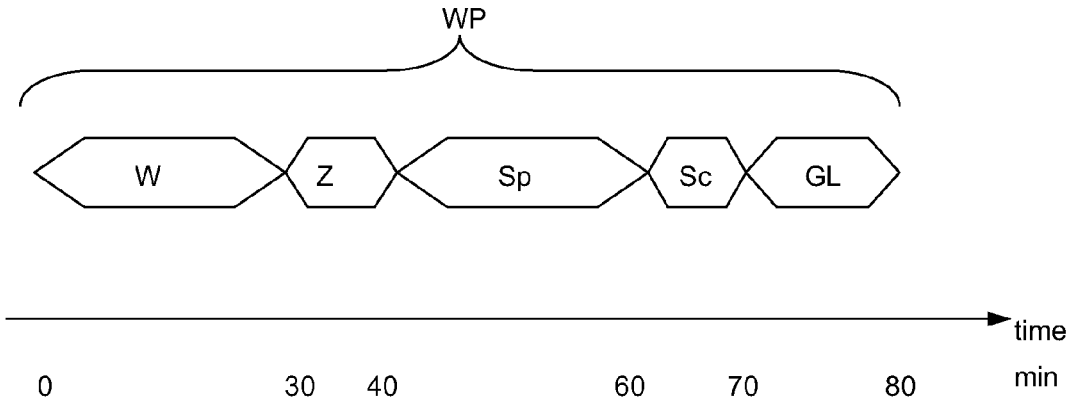
FIG. 2 is a diagram illustrating the time sequence of an overall wash cycle.

FIG. 2 is a diagram exemplarily illustrating the time sequence of an overall wash cycle WP. The durations of the individual sub-cycles of wash cycle WP are indicated in minutes on time axis t. The cycle sequence WP shown here includes a wash cycle W, an intermediate spin cycle Z, a rinse cycle Sp, and a spin cycle Sc, during which water is removed from the laundry. During these cycles, water inlet 15 and drain 16 are controlled accordingly. Moreover, heating element 7 is suitably controlled to heat the wash liquid to the predetermined temperature. Spin cycle Sc is followed by a cycle GL for smoothing laundry 7 which, in the present example, has a duration of about 10 minutes. The wash cycle is selected to last about 30 minutes, intermediate spinning lasts about 10 minutest, the rinse cycle about 20 minutes and the spin cycle Sc performed to remove water lasts about 10 minutes.

Figure 3A:
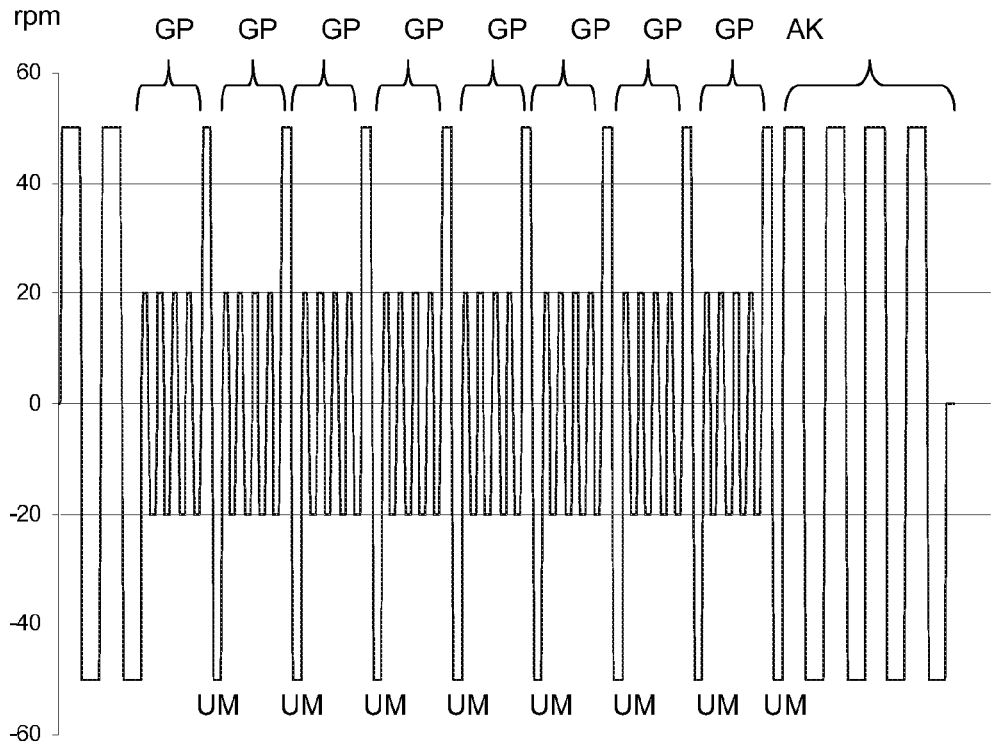
FIGS. 3*a* and 3*b* are diagrams illustrating the time sequence of smoothing cycle GL.
Figure 3B:
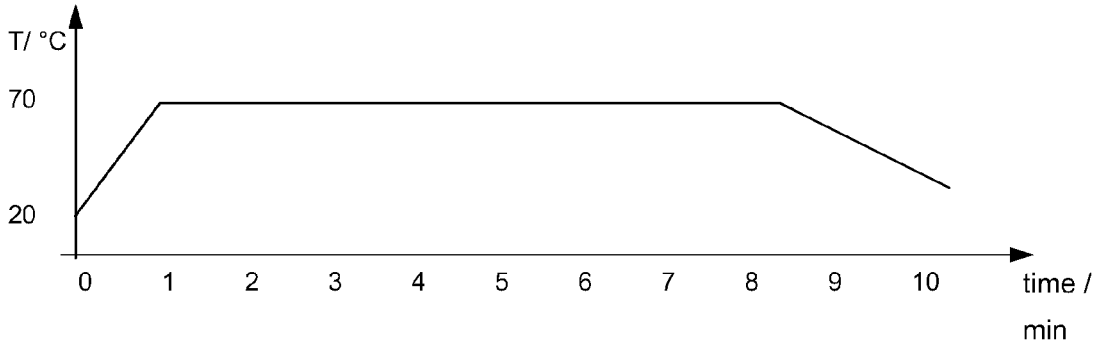

In FIG. 3*a* is a diagram showing cycle GL for smoothing the laundry with an enlarged time base. During the period from the start to time 1 minute, the laundry is moved in a reversing fashion at a speed of about 50 rpm. The falling of laundry so produced causes laundry items 8 to be repositioned and/or to come off drum wall 3*a* after the spin cycle. After the first minute, the smoothing of laundry 8 is performed, during which process drum 3 is rotated in reversing fashion at a relatively low speed of about 20 rpm. Because of the low speed, the laundry items 8 are lifted with drum wall 3*a* only to a level at which the laundry does not yet fall. This is the first phase GP, during which laundry 8 slides along drum wall 3*a*. After about 1 minute, the drum is rotated in a reversing fashion at a higher speed, here 50 rpm, for about 20 sec. so that a fall of laundry occurs, resulting in the repositioning (UM) of laundry 8. These two phases are repeated several times (in this example 7 times). In the process, heating element 7 is activated, so that, as shown in FIG. 3*b*, drum wall 3*a* is at a temperature of about 70° C during this period. After about 8 min, heating element 7 is turned off, while, as can be seen in FIG. 3*a*, the drum is rotated at the higher speed, here at about 50 rpm, as a result of which laundry 8 is loosened during cooling phase AK.

Figure 4:
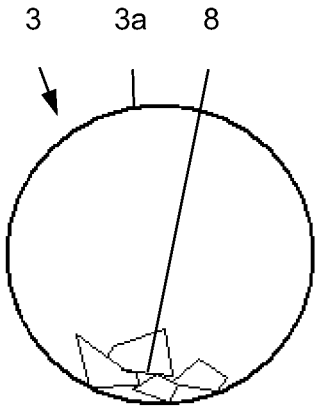
FIGS. 4 through 9 are schematic representations of the movements and positions of the drum.
Figure 5:
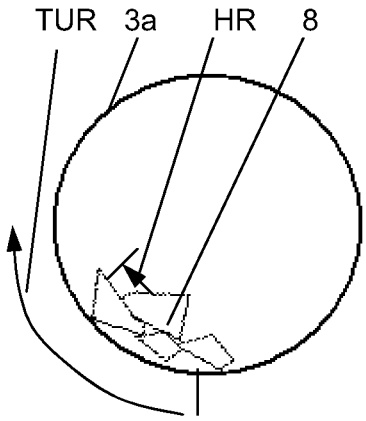
Figure 6:
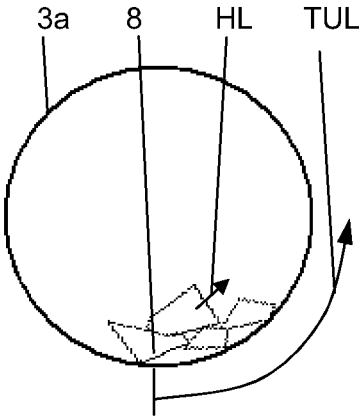
Figure 7:
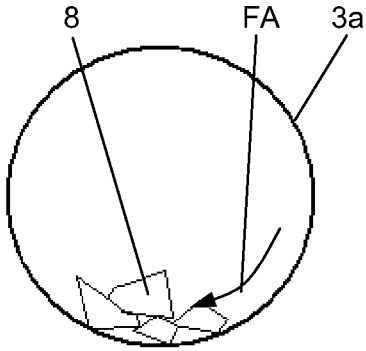

FIGS. 4 through 6 are schematic front views of the drum, illustrating the phase GP, during which laundry 8 slides along drum wall 3*a*. FIG. 4 shows the starting time point, at which laundry items 8 rest on drum wall 3*a* in the lower region thereof, here in a position referred to as 6 o'clock position. According to FIG. 5, drum 3 is rotated in a clockwise direction through a partial revolution TUR, here from the 6 o'clock position to the 9 o'clock position. During this process, laundry items 8 are lifted by only a fraction HR of the distance traveled by drum wall 3*a* during its partial revolution TUR. It can clearly be seen here that drum wall 3*a* slides along under laundry 8. According to FIG. 6, drum 3 is rotated in a counterclockwise direction through a partial revolution, here from the 6 o'clock position to the 3 o'clock position. During this process, laundry items 8 are lifted by only a fraction HL of the distance traveled by drum wall 3*a* during its partial revolution TUL. During this counterclockwise rotation, too, the surface of the drum wall slides along laundry 8. FIG. 7 shows that after the laundry is lifted by distance HL, it can slide back down along drum wall 3*a*, as is indicated by arrow FA.

Figures 8, 9:
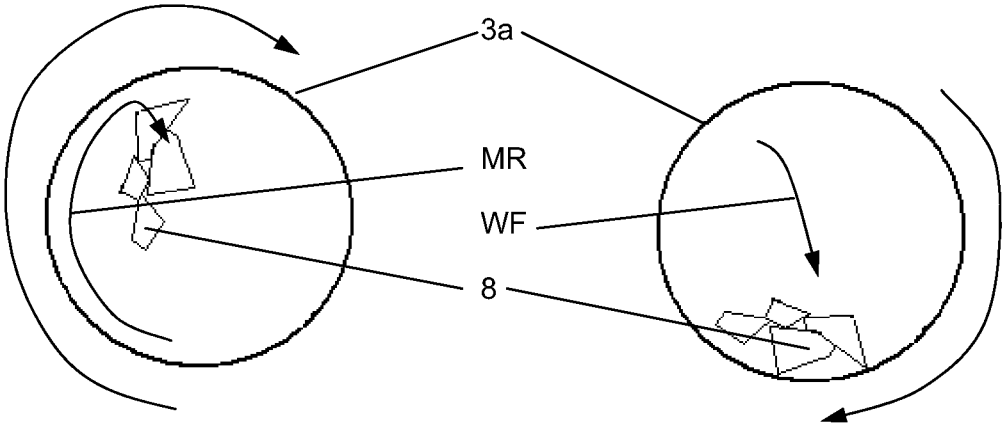

FIG. 8 illustrates the situation during the repositioning of the laundry within drum 3. Drum 3 is rotated through one or more revolutions at a higher speed, causing laundry 8 to be carried along MR to the 10 o'clock position. After that, the laundry detaches from drum wall 3*a*, resulting in a fall of laundry WF. As illustrated in FIG. 9, laundry 8 then rests on drum wall 3*a* in a changed position in the lower region thereof; i.e., in approximately the 6 o'clock position.

What is claimed is:

1. A method of treating laundry in a washing machine having a rotatable drum disposed in a suds container, the method comprising:

heating the drum wall with a heater during a laundry smoothing cycle; and rotating the drum during the smoothing cycle at a first speed so as to lift the laundry in the drum only to a height at which the laundry slides down the drum wall without falling.

2. The method of treating laundry as recited in claim 1, wherein the first speed is in a range of 15 to 25 rpm.

3. The method of treating laundry as recited in claim 1, wherein the rotating the drum includes rotating the drum through clockwise and counterclockwise partial revolutions.

4. The method of treating laundry as recited in claim 3, wherein the partial revolutions are within a range of one-quarter to one-half of a full revolution.

5. The method of treating laundry as recited in claim 1, wherein the heating drum is performed so as to heat the wall to a temperature in a range of about 50° C. to about 80° C.

6. The method of treating laundry as recited in claim 1, wherein the smoothing cycle includes:

at least one sliding phase in which the drum is rotated at the first speed for a range of two to six partial revolutions, and at least one subsequent repositioning phase in which the drum is rotated at a second speed so as to reposition the laundry within the drum.

7. The method of treating laundry as recited in claim 6, wherein the second speed is in a range of 40 to 60 rpm.

8. The method of treating laundry as recited in claim 6 wherein the at least one sliding phase includes at least two sliding phases respectively followed by at least a respective one of the at least one repositioning phase, wherein each sliding phase lasts about 30 to 60 seconds and each repositioning phase lasts about 5 to 10 seconds.

9. The method of treating laundry as recited in claim 8 wherein the at least one sliding phase includes 6 to 10 sliding phases, and wherein the smoothing cycle includes a cooling phase following the last repositioning phase of the repositioning phases during which the heater is off, the cooling phase including rotating the drum in reverse at the second speed for about 60 to 120 seconds.

10. The method of treating laundry as recited in claim 1 wherein the smoothing cycle has a total duration in a range of 6 to 12 minutes.

* * * * *